United States Patent [19]

De Luca et al.

[11] 4,132,814

[45] Jan. 2, 1979

[54] ANTI-DUSTING PROCESS FOR CARBON RESISTORS

[75] Inventors: Paul V. De Luca, Port Washington; William V. Carney, Valley Stream; Arnold S. Louis, Hastings on Hudson, all of N.Y.

[73] Assignee: Porta Systems Corp., Syosset, N.Y.

[21] Appl. No.: 849,506

[22] Filed: Nov. 7, 1977

[51] Int. Cl.[2] ..... B05D 1/18; B05D 5/12

[52] U.S. Cl. ..... 427/113; 427/114; 427/384; 427/443; 310/253

[58] Field of Search ..... 427/113, 114, 443, 384, 427/101; 310/253

[56] References Cited

U.S. PATENT DOCUMENTS

| | | | |
|---|---|---|---|
| 949,988 | 12/1904 | Mulvey | 427/113 |
| 2,934,460 | 4/1960 | Ramadanoff | 427/114 |
| 3,049,448 | 8/1962 | Millet | 427/114 |
| 3,996,408 | 12/1976 | Fridman et al. | 427/113 |

OTHER PUBLICATIONS

Hack's Chemical Dict., Ed. by J. Grant, (4th Edition), p. 534 (1969).

*Primary Examiner*—Michael F. Esposito
*Attorney, Agent, or Firm*—Charles E. Temko

[57] ABSTRACT

A process for impregnating carbon resistors used in the telephony art to reduce or eliminate dusting of carbon particles during arcing, thereby permitting gap distances to be accurately maintained, and the useful life of the electrodes to be extended. The process includes the immersion of completed electrodes into a water solution of polyethylene glycol, whereby the solution is absorbed between the carbon granules, following which the water vehicle is allowed to evaporate, leaving a thin coating of glycol which binds the carbon granules together without significantly altering the resistive qualities of the carbon.

1 Claim, No Drawings

ANTI-DUSTING PROCESS FOR CARBON RESISTORS

BACKGROUND OF THE INVENTION

This invention relates generally to the manufacture of carbon electrodes used to form arcing devices comprising components of telephone protector modules and the like. More particularly, it relates to an improved method for impregnating the completed electrode to make it more resistive to deterioration, or dusting, during its useful life span.

The use of carbon electrodes to form arcing devices in telephone protector modules is well-known in the art. Most commonly, a pair of such electrodes are positioned in end to end relation to form a small gap there between. The electrodes become conductive upon the occurrence of excessive line voltages and currents which are caused to arc across the gap and thereby dissipate the excess currents to a source of ground potential. One electrode is positioned within a ceramic sleeve, an edge of which contacts the other electrode and thereby maintains a pre-determined gap. With each occurrence of arcing, a few carbon particles are loosened from the body of one or the other of the electrodes, which particles tend to gather in the gap and ultimately destroy the gap by filling the original interstice, thereby nullifying the protections offered by the device in which the carbons are incorporated. The useful life span of the carbon is thereby determined, to a substantial degree, by the ability of the carbon electrodes to maintain their structural integrity.

Where the electrodes are formed from carbon particles in an organic binder, the original molding process is not a completed operation. At a subsequent step, when the electrode is bonded to the ceramic sleeve which houses it, heat employed in bonding destroys the original organic binder, to produce an effect somewhat resembling that of a sintered metallic powder having many voids between the individual carbon particles. During the passage of arcing, particles disposed at or near the arcing surface are dislodged from the main body of the electrode, exposing adjacent particles which in turn are then loosened by subsequent arcing.

SUMMARY OF THE INVENTION

Briefly stated, the invention contemplates the provision of an after bonding treatment in which the carbon electrodes and attached ceramic housings are immersed in a water solution of polyethylene glycol for a sufficient period of time to allow penetration of the interstices between the carbon particles, following which the electrodes and attached ceramic housings are retrieved and allowed to dry. With the evaporation of the water vehicle, a thin coating of polyethylene glycol is applied to each carbon particle, and to the outer surfaces of the electrode and housing which tend to further bind the carbon particles together and form a smooth protective coating which does not substantially affect the electrical resistivity of the carbon.

DETAILED DESCRIPTION OF THE DISCLOSED EMBODIMENT

The following example is illustrative:

An impregnating solution is prepared by adding approximately one ounce (dry weight) of polyethylene glycol (Union Carbide Corporation) to each gallon of water.

Maintaining the solution at or slightly above room temperature, the ceramic-bonded electrodes are immersed in the solution for a period of approximately five minutes, or until no further air bubbles are detected, indicating complete saturation. The electrodes are then retrieved from the solution and allowed to drain and subsequently dry, the drying process being optionally assisted by placing the same in an atmosphere of not over 140° F.

Upon evaporation of the water vehicle, the completed product will have a coating of polyethylene glycol approximately 0.0005 inch thick. As the size of the carbon particles is usually substantially greater, the exposed surfaces of the carbon particles will project through the coating and function in normal manner during arcing. However, any tendency to dust is counteracted by the impregnated coating, with the result that the useful life of the electrode is significantly extended.

The thickness of the coating may be varied by employing greater or lesser amounts of polyethylene glycol per gallon of water, which may be desirable depending upon the carbon particle size of the particular electrodes being treated.

We wish it to be understood that we do not consider the invention limited to the precise details of structure shown and set forth in the foregoing specification, for obvious modifications will occur to those skilled in the art to which the invention pertains.

We claim:

1. In the process of manufacturing carbon electrodes thermally bonded to a ceramic housing, in which the bonding process at least partially destroys the structural integrity of the electrode by creating voids between adjacent carbon particles, the steps of subsequently treating said electrodes comprising:

providing a water solution of polyethylene glycol of approximately one ounce per gallon of water;

submerging said electrodes in said solution for a time period sufficient to allow penetration through the entire body of the electrode; and retrieving said electrodes and allowing the water vehicle to evaporate, leaving the individual carbon particles comprising the electrode coated with a layer of polyethylene glycol of approximately 0.005 inch thick.

* * * * *